United States Patent [19]

Long et al.

[11] Patent Number: 4,948,714

[45] Date of Patent: Aug. 14, 1990

[54] PROCESSING OF PHOTOGRAPHIC SILVER HALIDE MATERIALS

[75] Inventors: William E. Long, Wilmslow; Kenneth M. McCombe, Altringham; Marion R. Palmer; Terence C. Webb, both of Wilmslow, all of England

[73] Assignee: Ilford Limited, Cheshire, England

[21] Appl. No.: 396,837

[22] Filed: Aug. 22, 1989

Related U.S. Application Data

[63] Continuation of Ser. No. 134,307, Dec. 15, 1987, abandoned.

[30] Foreign Application Priority Data

Dec. 17, 1986 [GB] United Kingdom ..... 8630/83

[51] Int. Cl.[5] ..... G03C 5/24; G03C 5/26

[52] U.S. Cl. ..... 430/435; 430/440; 430/445; 430/446; 430/489; 430/611

[58] Field of Search ..... 430/440, 445, 489, 611, 430/446, 435

[56] References Cited

U.S. PATENT DOCUMENTS

| | | | |
|---|---|---|---|
| 3,650,760 | 3/1972 | Gates, Jr. et al. | 430/611 |
| 4,636,456 | 1/1987 | Takahashi et al. | 430/489 |

FOREIGN PATENT DOCUMENTS

| | | |
|---|---|---|
| 1058606 | 2/1967 | United Kingdom . |
| 1400149 | 7/1975 | United Kingdom . |
| 1542705 | 3/1979 | United Kingdom . |

*Primary Examiner*—Paul R. Michl
*Assistant Examiner*—Patrick Doody
*Attorney, Agent, or Firm*—Wenderoth, Lind & Ponack

[57] ABSTRACT

Method of processing photographic silver halide material wherein an imagewise release of the development inhibitor 1-aryltetrazole-5-thiol is achieved during processing.

14 Claims, No Drawings

PROCESSING OF PHOTOGRAPHIC SILVER HALIDE MATERIALS

This application is a continuation of now abandoned application Ser. No. 134,307, filed Dec. 15, 1988 now abandoned.

This invention relates to a method of processing silver halide materials.

It is known that release of a development inhibiting species during development of silver halide material can lead to enhanced image quality, as described for chromogenic silver halide processing in the book "The Theory of the Photographic Process" 4th edition, edited by T.H. James, pages 343 and 610. A particularly useful development inhibiting species is 1-phenyltetrazole-5-thiol. There is a need to achieve similar image improvements during conventional monochrome black and white development by the controlled release of species such as 1-phenyltetrazole-5-thiol. Known compounds for achieving this are all of the developing agent class, such as the substituted hydroquinones described in British patent specification No. 1,400,149, and the substituted 4-sulphonamido phenols described in British patent specification 1,542,705. However there are problems associated with the use of all these compounds, particularly the fact that being good reducing agents they are susceptible to aerial oxidation and premature release of the development inhibitor. It has been proposed to use protected forms of the catechol compounds as described in British patent specification No. 1,400,419 and of the sulphonamido phenol compounds as described in British patent specification No. 1,542,705, but this protection lowers the activity of such compounds to unacceptable levels, particularly in developing solutions which have a low pH.

We have found that a class of mercapto substituted phenols may be used to effect such a release of development inhibitor.

Therefore according to the present invention there is provided a method of processing photographic silver halide material wherein an imagewise release of the development inhibitor 1-aryltetrazole-5-thiol is achieved during processing which method comprises subjecting photographic silver halide material to an imagewise exposure, developing the latent image by use of a black and white developing solution in the presence of a phenol compound of the general formula I

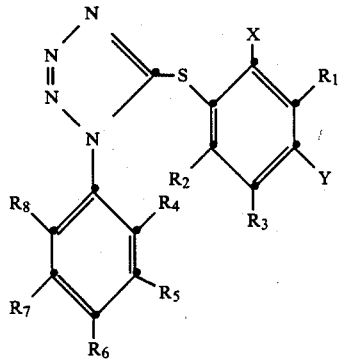

wherein one or both of the substituents X and Y is a hydroxy group, and the other substituent X or Y, and the substituents $R_1$, $R_2$, $R_3$, $R_4$, $R_5$, $R_6$, $R_7$ and $R_8$ are each hydrogen, alkyl, substituted alkyl, alkoxy, substituted alkoxy, aryl, substituted aryl, aryloxy, substituted aryloxy, acyloxy, substituted acyloxy, dialkyl amino, alkyl thio, substituted alkyl thio, halogen, sulphonic acid, or metal salts thereof sulphonamide, carboxylic acid metal salts thereof, ester or amide groups and wherein any two adjacent substitutent groups may represent the atoms necessary to complete a heterocyclic or carbocyclic annelated ring which is optionally substituted.

Possible substituent groups for substituted alkyl, alkoxy, aryl, aryloxy, acyloxy, alkyl thio, heterocyclic or carbocyclic annelated rings include halogen atoms, preferably chlorine, hydroxy groups, carboxylic acids or metal salts thereof, carboxylic esters, preferably containing 2 to 6 carbon atoms, carboxylic amides, sulphonamides each having 1 to 4 carbon atoms in the amide moiety, and sulphonic acids and metal salts thereof.

The compounds of formula I may usefully be incorporated in silver halide developing composition, or alternatively may be incorporated in the silver halide photographic material either in solution in the coating medium, or in solution in an oil phase dispersed in the coating medium. If the compound is to be used in a developing solution, or if it is to be dissolved in the aqueous coating medium then it is advantageous for the substituents X, Y, $R_1$, $R_2$, $R_3$, $R_4$, $R_5$, $R_6$, $R_7$ and $R_8$ to be small or to include water solubilising groups. Therefore preferably the substituents X, Y, $R_1$, $R_2$, $R_3$, $R_4$, $R_5$, $R_6$, $R_7$ and $R_8$ are hydrogen, lower alkyl groups such as methyl, ethyl or propopyl groups, lower alkoxy groups such as methoxy, ethoxy, or propoxy groups, or water solubilising groups such as carboxy, carboxy methyl, carboxy methoxy, hydroxy methyl or hydroxy ethoxy groups.

If the compounds are to be incorporated in the photographic material dissolved in an oil dispersion then preferably one or more of the groups X, Y, $R_1$, $R_2$, $R_3$, $R_4$, $R_5$, $R_6$, $R_7$ and $R_8$ comprises an oil solubilising ballasting group containing at least 4 carbon atoms, for example butyl, butoxy, tert-butyl, hexyl, hexyloxy, heptyl, heptyloxy, or substituted phenyl or phenoxy groups such as p-t-butyl phenoxy and p-t-amyl phenoxy.

Preferably, the groups $R_4$, $R_5$, $R_6$, $R_7$ and $R_8$ are all hydrogen. Thus these compounds of formula I release 1-phenyl tetrazole-5-thiol upon development.

Preferably at least one of the groups $R_1$, $R_2$ and $R_3$ is an electron donating group such as an alkyl or alkoxy group.

Thus the preferred compounds of formula I in the claimed method are those of formula II

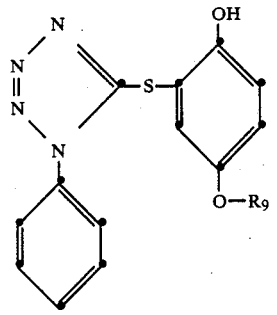

wherein $R_9$ is an alkyl or substituted alkyl group. A useful substituted alkyl group is carboxy methyl.

When the compound of formula I is included in silver halide developing compositions these compositions usefully include the other components generally present in such compositions, for example developing agents such as hydroquinone or 4-methylamino phenol, bases such as sodium carbonate or sodium hydroxide, antioxidants such as sodium sulphite, and restrainers such as sodium bromide, together with other components commonly found in such solutions, as described in the book "Photographic Processing Chemistry" by LFA Mason, published by the Focal Press. When the compound of formula I is incorporated in a silver halide developing composition it may be used in a concentration of up to 10 g/liter, depending on the effect desired and upon the molecular weight and activity of the compound. However, preferably the compound of formula (I) is used at a level of up to 1 g/liter and most preferably at a level of about 0.1 g/liter.

When the compound of formula (I) is incorporated in a silver halide photographic layer then such a system usually include additives commonly found in photographic silver halide layers, for example sensitising dyes, stabilizers, and wetting agents, together with gelatin or other binders and the silver halide, which may be silver chloride, bromide, or iodide or mixed halides, as described in the book "The Theory of the Photographic Process" edited by T.H. James.

The compound of formula I may be present in such a layer to give a coating weight up to 10 mg/dm$^2$, but preferably between 1 mg/dm$^2$ and 0.1 mg/dm$^2$.

The compounds of formula (I) are preferably used with fine grain silver halide emulsions including the so called Lippmann emulsions, and are of particular use in silver halide holograpic emulsions.

Some of the compounds included in the general formula I are known compounds and their use in photographic silver halide materials as silver halide incubation stabilizers is described in U.S. Pat. No. 3,650,760. However, compounds A to I as hereinafter set forth are novel compounds. All the compounds covered by formula I may be prepared by methods described in Chapman et al Journal of Organic Chemistry, Volume 30, Part 1, 520 (1965).

There is no suggestion in U.S. Pat. No. 3,650,760 that there is any release of a development inhibitor fragment during processing from any of the compounds described in U.S. Pat. No. 3,650,760. In fact it is not clear why there should be any such release from the compounds of formula I. These compounds are not strong reducing agents and thus they do not help to develop the latent silver images as do the compounds described in B.P. 1,058,606, B.P. 1,400,149 and B.P. 1,542,705. Furthermore they do not couple with oxidised developer to release the D.I. moiety. However it is thought that there is some sort of action on them by oxidised black and white developer which causes an imagewise release of the thiol compound.

The preferred black and white developing agent for use in the process of the present invention is hydroquinone.

In the method of the present invention preferably after the silver image has been developed in the material the unexposed silver halide is fixed out, or stabilised in known manner.

The following novel compounds of the formula III are of particular use in the process of the present invention:

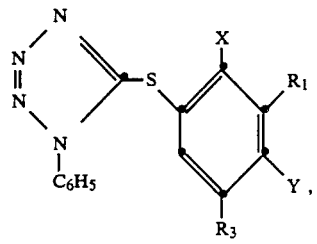

wherein X and Y are hydrogen or hydroxy, $R_1$ is hydrogen or methyl, $R_3$ is methyl, methoxy, —$CO_2H$, —$CH_2CO_2H$, —$OCH_2CO_2H$ or $R_3$ forms together with Y a radical of the formula —$OCH_2O$—.

Particularly important compounds of the formula III are the compounds A to I of the following formulae:

Compound A

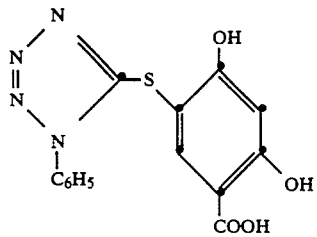

Compound B

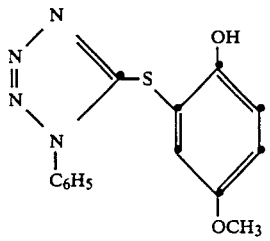

Compound C

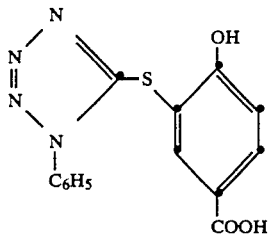

Compound D

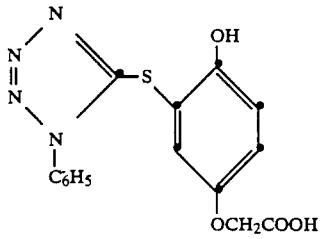

Compound E

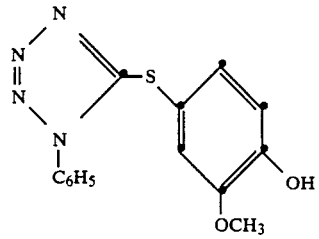

-continued

Compound F

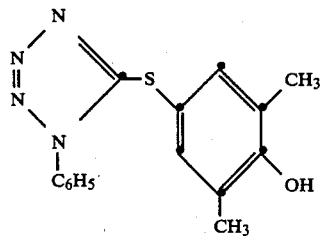

Compound G

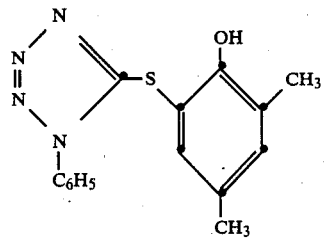

Compound H

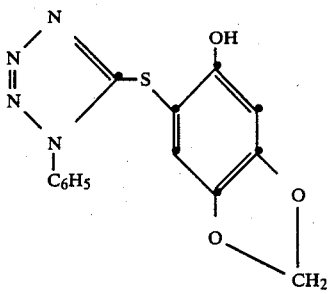

Compound I

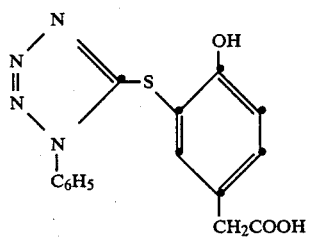

PREPARATION 1

Synthesis of Compound A 1-phenyl tetrazole-5-thiol (11.88 g) was dissolved in glacial acetic acid (100 ml) at 40° C., and sulphuryl chloride (6 ml) in glacial acetic acid (40 ml) was added dropwise with stirring. The clear yellow solution was stirred at 40° C. for 15 min., and then added to 2,4-dihydroxybenzoic acid (10.17 g) in glacial acetic acid (200 ml) at 60° C. The solution was stirred at 60° C. for 2 and a half hours, during which time a white solid appeared. This was filtered off, yield 13.91 g, mp 219°-220° C., and could be recrystallised from acetic acid.

The following compounds were also prepared by an analogous route:

| Compound | | mp |
|---|---|---|
| | B | 124-126° C. |
| | C | 203-206° C. |
| | D | 168-170° C. |
| | E | 149-150° C. |
| | F | 208-210° C. |
| | G | 125-128° C. |
| | H | 172-173° C. |
| | I | 166-167° C. |

Examples 1 and 2 show the development inhibiting effect of the compounds prepared as above, and Example 3 shows that this effect is caused by the release of phenyl tetrazole-5-thiol.

The following Examples will serve to illustrate the present invention:

EXAMPLE 1

The inhibition of development using compounds of formula (I) is shown by measuring the speed loss of films processed in developing compositions containing these compounds. Comparative compound K was prepared according to British patent specification 1,400,149.

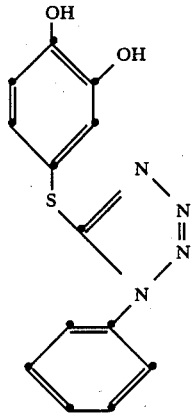

Compound K
[compound (5) of
GB 1,400,149]

Sensitometric wedges were exposed on strips of a commercially available 400 A.S.A. monochrome silver halide photographic film material. The length of exposure was 1/30 second at 250 lux.

The strips of film were developed for 8 minutes in a hydroquinone/metol black and white developing solution of the following formula:

| | |
|---|---|
| hydroquinone | 5 g |
| metol | 2 g |
| Sodium sulphite anhydrous | 100 g |
| borax | 2 g |
| water to | 1 liter |
| pH | 8.6 |
| temperature of developing solution | 20° C. |

The strips of film were then washed with water for half a minute and then fixed in a silver halide fixer of the following formula:

| | |
|---|---|
| ammonium thiosulphate | 135 g |
| boric acid | 7 g |
| sodium acetate | 10 g |
| sodium metabisulphite | 5 g |
| sodium sulphite | 6 g |
| water to | 1 liter |
| pH | 5.2 |

The strips were then washed for 10 minutes in running water and air dried.

The developed silver density and speed was measured.

Development inhibiting compounds were then added to the standard developer at a concentration of 1/1000 molar. Identically exposed wedges of commercial 400 ASA camera film were then developed in the test developer, and then fixed, washed and the densities measured as before. The loss of speed caused by the development inhibiting compounds was measured as below

| Compound | Loss in speed (Log E) |
|---|---|
| Control Compound K | 0 |
| Compound B | 0.69 |
| Compound D | 0.83 |
| Compound A | 0.16 |
| Compound C | 0.25 |
| Compound E | 0.31 |

The greater activity of the compound of formula (I) over the previously known compound K under these conditions is shown.

EXAMPLE 2

The tests of Example 1 were repeated using a concentration of 1/100 molar of the inhibiting compound in the developer solution. For the more active compounds, especially compound D, this concentration is too great to be useful.

| Compound | Loss in speed (Log E) |
|---|---|
| Control Compound K | 1.28 |
| Compound D | no development obtained |
| Compound C | 1.74 |
| Compound A | 1.55 |

EXAMPLE 3

Analysis of the Released 1-Phenyltetrazole-5-thiol.

When 1-phenyltetrazole-5-thiol is released in the presence of silver halide, the silver salt is formed. The analysis of this compound is difficult, therefore the analysis described below relies on converting the silver salt to the methyl derivative which can easily be analysed by high performance liquid chromatography (h.p.l.c.).

A conventional silver iodobromide photographic emulsion was prepared. A solution of compound D in water was added to a portion of this emulsion to give a ratio of 1/30 of the weight of silver in the emulsion. This emulsion was then coated on 130 μm thick triacetate base, and a control coating was also prepared under the same conditions but without the addition of compound D. Samples of each of the coatings were exposed to white light, and then developed in the standard metol/hydroquinone developer used in Example 1 at pH 8.6 for 8 minutes at 20° C., and washed without fixation.

Further samples of each of the coatings were then exposed to white light, and treated in a pH 8.6 buffer solution for 8 minutes at 20° C., and washed.

Each of the above samples was then shredded, and the silver halide isolated by centrifugation after treatment with 0.05% Pronase enzyme solution. The isolated silver halide, which should contain the released 1-phenyl tetrazole-5-thiol, as the silver salt was washed and dried, ground up, and refluxed with methyl iodide (2 ml) in dichloromethane (10 ml) for 2 hours. The unwanted silver halide was removed by centrifugation, and the solvent removed. The residue was analyzed for 1-phenyl-5-methylthio-tetrazole by h.p.l.c. using a 5 μ C reverse phase and 60:40 methanol/water as the eluent.

RESULTS

1-Phenyl-5-methylthiotetrazole was found and is expressed as a percentage of the original compound D used in the coatings:

| | |
|---|---|
| After development at pH 8.6 | 3.3% recovered |
| After treatment with pH 8.6 buffer | <0.1% recovered |

These results show that 1-phenyltetrazole-5-thiol is released upon development.

As a final control a coating was prepared containing 1-phenyltetrazole-5-thiol in the same ratio as compound D above, which is sufficient to inhibit development completely. On treatment of this coating using the isolation procedure described above, the isolated 1-phenyl-5-methylthiotetrazole was equivalent to 39% of the original thiol used.

EXAMPLE 4

A holographic gelatino silver iodobromine emulsion was prepared with a medium crystal size of 0.04 μm and a gelatin content of 162 g per mole of silver. The emulsion was sensitised with gold and sulphur, and then with 0.4 g per mole of silver with a red sensitising dye, and then 0.67 grams per mole of silver of compound D above was added. This emulsion was then coated on a 100 μ subbed polyester base, to give a silver coating weight of 3.0 g/m$^2$, and a supercoat of 1.1 g/m$^2$ of gelatin was then coated on top of the dried emulsion layer. This coating is sample 1.

As a control, a second emulsion was prepared as above, except that comparative compound K was added at 0.83 g/mole of silver instead of compound D. This emulsion was coated as above. This coating is sample 2.

As a final control, a third emulsion was prepared and coated as above, except that the known stabiliser of formula L was added at 3.33 g/mole of silver instead of the DIR compounds D or K. This coating is sample 3.

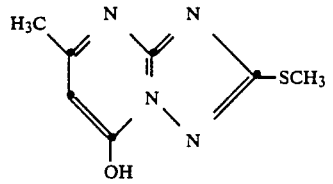

Compound L

Strips of the samples 1, 2 und 3 prepared above were holographically exposed in the Denisyuk mode using light of wavelength 632.8 n.m. from a Helium, Neon laser. The object was a shot blasted stainless steel plate, and the light intensity measured at the film was 0.665 mW/cm$^2$. Each sample was exposed for 0.25 seconds with a 0.2 neutral density filter.

The samples were then developed separately for 3 minutes at 30° C. in a developing solution of the following composition:

| | |
|---|---|
| Hydroquinone | 10 g |
| Sodium carbonate | 60 g |
| Sodium sulphite | 30 g anhydrous |
| Water to | 1 liter |

The samples were then bleached in a rehalogenating bleach containing ferric sodium DTPA for 4 minutes at 30° C., and then washed in running water for 1 minute.

After drying, the resulting holograms were illuminated with light of wavelength 350–700 nm, and the reflected light density measured using a Pye Unicam PU 8800 spectrophotometer. The holographic efficiency at peak reflectance was calculated for each sample:

| | | Compound contained | Reflectivity % | Holographic Diffraction Efficiency % |
|---|---|---|---|---|
| Sample | 1 | D | 27.3 | 70 |
| | 2 | K | 21.0 | 50 |
| | 3 | L | 22.5 | 58 |

It will be seen that compound D gives a hologram with considerably improved performance when compared with the compounds K or L.

The formula of the rehalogenating bleach bath used as follows:

| | |
|---|---|
| pentasodium diethylenetriamine pentaacetic acid (37% w/w solution) | 140 ml |
| ferric nitrate (this is equivalent to 45 g/liter of ferric D.T.P.A.) | 40.4 g |
| potassium bromide | 10 g |
| pH | 2.0 g |
| water to | 1 liter |

We claim:

1. A method of processing photographic silver halide material wherein an imagewise release of the development inhibitor 1-aryltetrazole-5-thiol is achieved during processing which method comprises subjecting photographic silver halide material to an imagewise exposure, developing the latent image by use of a black and white developing solution in the presence of a phenol compound of the general formula I

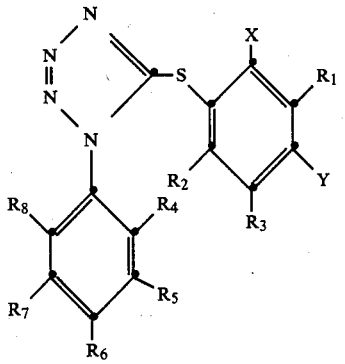

wherein one or both of the substituents X and Y is a hydroxy group, and the other substituent X or Y, and the substituents $R_1$, $R_2$, $R_3$, $R_4$, $R_5$, $R_6$, $R_7$ and $R_8$ are each hydrogen, alkyl, substituted alkyl, alkoxy, substituted alkoxy, aryl, substituted aryl, aryloxy, substituted aryloxy, dialkyl amino, alkyl thio, substituted alkyl thio, halogen, sulphonic acid or a metal salt thereof, or carboxylic acid or a metal salt thereof, ester or amide groups and wherein any two adjacent substituent groups may represent the atoms necessary to complete a heterocyclic or carbocyclic annelated ring which is optionally substituted.

2. A method according to claim 1 wherein the compounds of formula I are present in the black and white developing solution.

3. A method according to claim 1 wherein the compounds of formula I are present in the silver halide photographic material.

4. A method according to claim 2 wherein the silver halide photographic material contains a Lippmann fine grain silver halide emulsion.

5. A method according to claim 2 wherein the compounds of formula I are incorporated into the silver halide photographic material in solution in the coating medium.

6. A method according to claim 3 wherein the compound of formula I the substituents X, Y, $R_1$, $R_2$, $R_3$, $R_4$, $R_5$, $R_6$, $R_7$ and $R_8$ are hydrogen, lower alkyl groups, lower alkoxy groups or water solubilising groups.

7. A method according to claim 3 wherein the compound of formula I is incorporated into the silver halide photographic material in an oil phase dispersed in the coating medium.

8. A method according to claim 7 wherein the compound of formula I one or more of the groups X, Y, $R_1$, $R_2$, $R_3$, $R_4$, $R_5$, $R_6$, $R_7$ and $R_8$ comprises an oil solubilising ballasting group containing at least 4 carbon atoms.

9. A method according to claim 1, wherein the compounds of formula I $R_2$ and $R_4$ to $R_8$ are hydrogen, X and Y are hydrogen or hydroxy, $R_1$ is hydrogen or methyl, $R_3$ is methyl, methoxy, $—CO_2H$, $—CH_2CO_2H$, $—OCH_2CO_2H$ or $R_3$ forms together with Y a radical of the formula $—OCH_2O—$.

10. A method according to claim 1 wherein the phenol compound is of the formula II

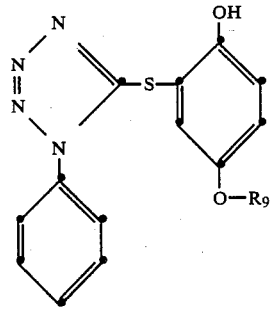

wherein $R_9$ is an alkyl or substituted alkyl group.

11. A method according to claim 2 wherein the concentration of compound of formula I present in the developing solution is about 0.1 g/liter.

12. A method according to claim 3 wherein the compound of formula I is incorporated in a silver halide layer of the photographic material at a coating weight of between 1 mg/dm$^2$ to 0.1 mg/dm$^2$.

13. A method according to claim 1 wherein the black and white developing solution comprises hydroquinone.

14. Photographic silver halide material which has been processed by the method claimed in claim 1.

* * * * *